US006468141B1

(12) United States Patent
Conboy et al.

(10) Patent No.: US 6,468,141 B1
(45) Date of Patent: Oct. 22, 2002

(54) DRYWALL SANDER

(75) Inventors: John S. Conboy, 2235 Devonsbrook Dr., Chesterfield, MO (US) 63005; Gerald E. Amies, St. Louis, MO (US)

(73) Assignee: John S. Conboy, Chesterfield, MO (US)

( * ) Notice: Subject to any disclaimer, the term of this patent is extended or adjusted under 35 U.S.C. 154(b) by 13 days.

(21) Appl. No.: 09/718,276

(22) Filed: Nov. 22, 2000

(51) Int. Cl.[7] ..... B24B 23/00
(52) U.S. Cl. ..... 451/354; 451/351; 451/344
(58) Field of Search ..... 451/354, 351, 451/356–358; 280/702

(56) References Cited

U.S. PATENT DOCUMENTS 3,483,662 A * 12/1969 Ames ..... 451/354
4,685,252 A * 8/1987 Ponce ..... 451/354
4,974,371 A 12/1990 Conboy
5,144,774 A 9/1992 Conboy
5,154,442 A * 10/1992 Miliken ..... 280/702
5,193,313 A * 3/1993 Sanchez et al. ..... 451/354
5,205,079 A * 4/1993 Lashley et al. ..... 451/354
5,345,206 A 9/1994 Morcos
6,053,805 A * 4/2000 Sanchez ..... 451/456

FOREIGN PATENT DOCUMENTS

EP 333933 * 9/1989 ..... 451/354

* cited by examiner

*Primary Examiner*—George Nguyen
(74) *Attorney, Agent, or Firm*—Polster, Lieder, Woodruff & Lucchesi, L.C.

(57) ABSTRACT

A drywall sander comprises a handle, a sanding head adapted to being reciprocated for back and forth motion, a moving coil actuator associated with the sanding head for reciprocating the sanding head, and a universal joint for connecting the handle to the moving coil actuator.

17 Claims, 3 Drawing Sheets

DRYWALL SANDER

BACKGROUND OF THE INVENTION

This invention relates to the field of electric hand tools, and in particular, relates to a drywall sander, which can be used to sand in tight corners and in high places.

Presently, sanding of joint compound, sometimes called mud, which is used to cover nail heads driven into drywall and to cover tape which applied to drywall joints, is accomplished by either hand sanding or by use of a powered drywall sander. Sanding by hand is a tedious and time consuming endeavor. Hand sanders also tend to stick and tear the drywall paper and the sandpaper typically becomes clogged with drywall compound and becomes ineffective. Additionally, in order to sand ceilings or other high areas, a drywaller has to use stilts or erect scaffolding. Since there are safety concerns when using stilts or scaffolding, it would be more practical, safe, and convenient to be able to use a power sander which could reach high areas. Although existing power sanders are useful devices, there are some disadvantages associated with their use. One such disadvantage is that known power sanders are rotary type sanders that leave swirl marks in the joint compound. In order to remove these marks, hand sanding is required which negates some of the advantage of using the rotary type power sander. Another disadvantage with use of a rotary power sander is that care must be exercised because the power is such that it can easily damage the tape, the joint compound, or the underlying sheet of drywall. It is also known to use a power sander fitted to an extension pole or handle. However, it has been found that due to the weight of the rotary power sander, use of the extension becomes tiresome and difficult over extended periods of use. Further, prolonged use of a power sander fitted to an extension handle may result in serious injuries to the shoulders and the back of a drywaller.

Another problem associated with existing power sanders is that the motors which are used tend to wear out very quickly. This is due to drywall compound dust, which is abrasive, interacting with or being deposited on the motor brushes and bearing. The dust makes the motor work harder which generates more heat. The motor needs to be cooled to reduce the generated heat. This requires active cooling of the motor, which also increases the weight of the sander.

The present invention is designed to obviate these problems and overcome many of the disadvantages and shortcomings associated with present handheld and power drywall sanders. In particular, the present invention is a drywall sander which may be used to easily sand corners, restricted areas, and ceilings. Moreover, the drywall sander of the present invention, due to its maneuverability and light or reduced weight can be employed to sand corners and ceilings over longer periods of time.

SUMMARY OF THE INVENTION

In one form of the present invention, a drywall sander comprises a handle, a sanding head adapted to being reciprocated for back and forth motion, a power actuating means associated with the sanding head for reciprocating the sanding head, the power actuating means comprising a drive system having a tuned spring mass centering system, and a universal joint for connecting the handle to the power actuating means.

In another form of the present invention, a lightweight electrically operated drywall sander comprises a handle, a sanding head adapted to being reciprocated, a drive system associated with the sanding head for reciprocating the sanding head, and a universal joint for connecting the handle to the drive system for moving the handle relative to the sanding head into various positions.

Another form of the present invention is a drywall sander which comprises a handle, a sanding head adapted for reciprocating motion, a moving coil actuator for providing the reciprocating motion to the sanding head, a pre-loaded spring centering system for centering the sanding head prior to the sanding head being reciprocated, and a universal joint for connected the handle to the motor and for moving the sanding head relative to the handle.

In light of the foregoing comments, it will be recognized that a principal object of the present invention is to provide an improved drywall sander.

Another object of the present invention is to provide a drywall sander which is of simple construction and design and which can be easily employed with highly reliable results.

A further object of the present invention is to provide a drywall sander that has a reciprocating sanding surface in which a handle is connected to the sanding surface in such a manner that a pivot point is close to the drywall to be sanded in order to reduce the tendency of the sanding head to flip over while the sander is in use.

A still further object of the present invention is to provide a drywall sander which has a universal joint connection between a handle and a sanding head, with the universal joint connection providing movement of the sanding head relative to the handle in two planes while preventing rotational movement of the sanding head relative to the handle.

Another object of the present invention is to provide a drywall sander which is compact in design and light in weight which allows an operator of the sander to use the sander for long durations.

These and other objects and advantages of the present invention will become apparent after considering the following detailed specification in conjunction with the accompanying drawings, wherein:

DETAILED DESCRIPTION OF THE PREFERRED EMBODIMENTS

Figure 1:
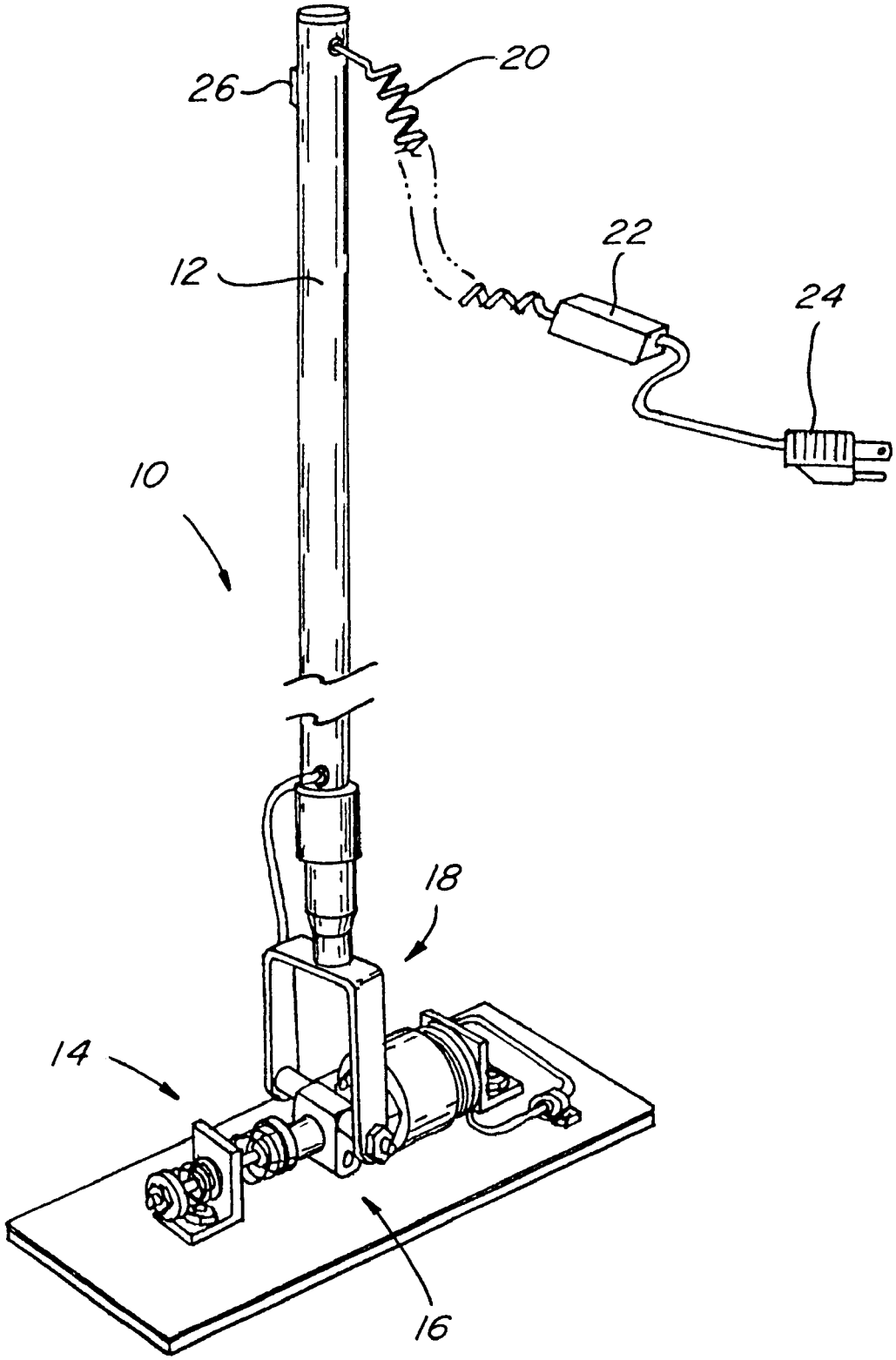
FIG. 1 is a perspective view of a preferred embodiment of a drywall sander constructed according to the present invention.

Referring now to the drawings, wherein like numbers refer to like items, number 10 identifies a preferred embodiment of a drywall sander 10 constructed according to the present invention. With reference now to FIG. 1, the drywall sander 10 comprises a handle 12, a sanding head 14 which is adapted for reciprocating motion, a drive system 16 for moving or reciprocating the sanding head 14, and a universal joint device 18 for connecting the handle 12 to the drive system 16. An electrical cord 20 is inserted through the handle 12 and is connected to a low voltage transformer 22. The low voltage transformer 22 includes an electrical plug 24 for connecting to an A.C. electrical source (not shown) for providing power to the sander 10. A power switch 26 is provided in the handle 12 for turning the sander 10 on or off. The sander 10 is used to sand drywall joint compound which has been applied to drywall and drywall joints. The drive system 16 is used to move or reciprocate the sanding head 14 at high speeds when sanding joint compound. The speeds that may be obtained by the sander 10 are greater than 3 feet per second. At this speed, dust is not able to accumulate on the sanding head 14 and the sandpaper which is used with the sanding head 14 may be used for extended periods of time.

Figure 2:
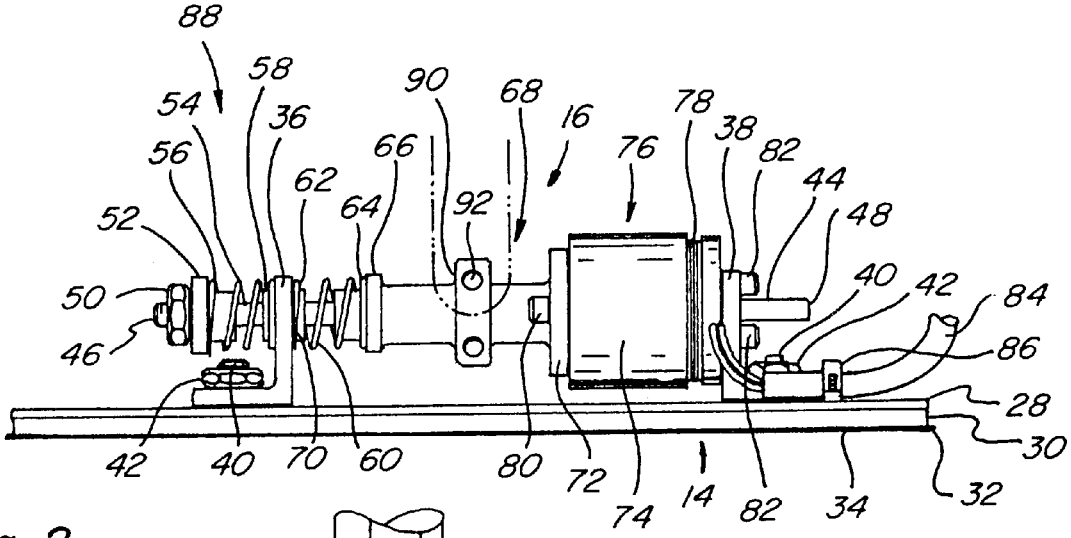
FIG. 2 is an enlarged partial perspective view of a sanding head of the drywall sander shown in FIG. 1.

Referring now to FIG. 2, the sanding head 14 and the drive system 16 are illustrated with the handle 12 being removed from the drive system 16. The sanding head 14 includes a base portion 28 which is generally rectangular in shape. A foam pad 30 is attached to the base portion 28 and the pad 30 presents a surface 32 upon which a sheet of sand paper 34 may be adhesively secured. The sanding head 14 is shown to have the drive system 16 connected to the head 14 by the use of a pair of brackets 36 and 38. Screws 40 and nuts 42 may be used to fasten the brackets 36 and 28 to the base portion 28. A shaft 44 is inserted through the brackets 36 and 38 and the shaft 44 has a first threaded end 46 and a second end 48. A nut 50 is threaded on the end 46 and this holds a retaining cup member 52 in place against the bias of a first spring 54. The first spring 54 has a first end 56 which abuts up against the retaining cup member 52 and a second end 58 which is positioned against the bracket 36. A second spring 60 has a first end 62 positioned against the bracket 36 and a second end 64 abutting a cup retaining end 66 of a pivot block member 68. The bracket 36 also includes a bearing member 70 which allows the shaft 44 to freely move and/or rotate therein.

The pivot block member 68 has a second end 72 which is attached to a magnetic cup member 74 of a motor 76. The motor 76 also includes a moving coil member 78 which fits within the magnetic cup member 74. The second end 72 is secured to the magnetic cup member 74 by screws 80. The pivot block member 68 is adapted to fit over the shaft 44 and is free to rotate with the shaft 44. A pair of screws 82 secures the coil member 78 to the bracket 38 or the coil member 78 may be attached using alternate fastening means or methods. In this manner, the coil member 78 is attached to the sanding head 14, while the cup member is free to rotate about the coil member 78. Although not shown, the coil member 78 includes an internal bearing through which the shaft 44 is inserted. A wire 84, such as low voltage wire, is connected to the coil member 78 and the wire 84 is also connected to the switch 26. A bracket 86 may also be used to secure the wire 84 to the base portion 28 to prevent movement of the wire 84.

The motor 76 is used to reciprocate the sanding head 14, as will be explained. An example of the motor 76 is a moving coil actuator which is disclosed in U.S. Pat. No. 5,345,206. Other examples of the motor 76 are linear motors, solenoids, and lightweight D.C. motors. The stroke of the motor 76, which is a measurement of the movement of the cup member 74 relative to the coil member 78 is about ±0.22 inches. The motor 76 requires low voltage, about 18 volts, for operation. Additionally, the motor 76 is light in weight. The motor 76 is also an example of a power actuating means which is capable of reciprocating the sanding head 14.

The first and second springs 54 and 60 along with the bracket 36, the retaining cup member 52, and the cup retaining end 66 form a pre-loaded spring centering system 88. The pre-loaded spring centering system 88 acts as a tuned spring mass energy storage device for the reciprocating motion of the sanding head 14. The system 88 is tuned to 60 Hz, the frequency of the motor drive voltage. Further, the springs 54 and 60, which may be compression springs, are about 100 pounds per inch. Other springs may be used depending about the voltage frequency requirements of the particular country in which the sander 10 is being used. For example, the system 88 may be tuned to 50 Hz when the sander 10 is being used in Europe with the appropriate selection of springs. The tuned spring mass centering system 88 is used to center the sanding head 14 when the sander 10 is not being used or to provide for an initial centering position prior to use. The tuned spring mass centering system 88 further minimizes the input power required in no load or loaded conditions. This also reduces the heat generated by the motor 76 and provides extra starting force at the point at which the head 14 reverses.

The pivot block member 68 further includes a central block portion 90 which has a central cavity or channel 92. The channel 92 allows a pin (not shown) to be placed therethrough for connecting the handle 12 to the drive system 16, as will be explained. As can be appreciated, the pivot block member 68 is free to rotate with the shaft 44 due to the second end 72 being connected to the cup member 74, which rotates about the coil member 78, and the cup retaining end 66 being held in place by the second spring 60. The pre-loaded spring centering system 88 provides some resistance in rotation of the sanding head 14 about the shaft 44. Further, the central block portion 90 prevents full rotation of the sanding head 14. In other words, the sanding head 14 is able to rotate about the shaft 44 in half an arc or about 180° of rotation.

Figure 3:
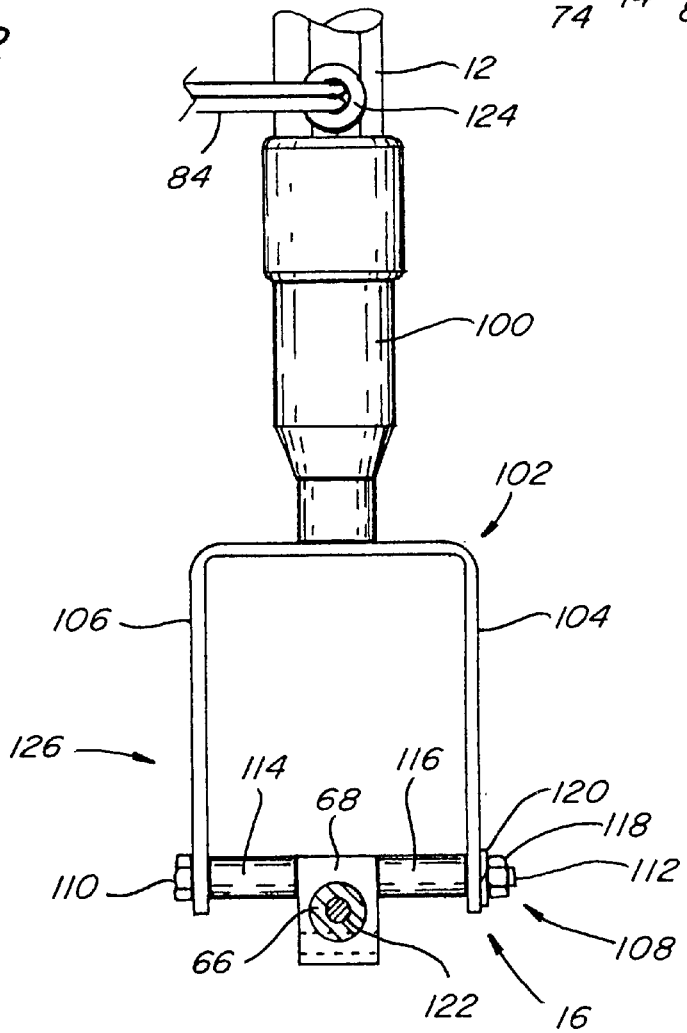
FIG. 3 is an enlarged partial perspective view of a universal joint device of the drywall sander shown in FIG. 1.

FIG. 3 depicts a partial representation of the manner in which the handle 12 is connected to the drive system 16. In FIG. 3, the pivot block member 68 is shown being removed from the shaft 44. In particular, the handle 12 has an end portion 100 which is connected to a yoke or fork portion 102. The fork portion 102 has a pair of ends 104 and 106 through which is inserted a bolt or a pin 108. The pin 108 has a head 110 and a threaded end 112. The pin 108 has also been inserted through the channel 92 of the central portion 90 of the pivot block member 68. A first spacer 114 is placed around the pin 108 between the central portion 90 and the end 106. A second spacer 116 is inserted onto the pin 108 and positioned between the central portion 90 and the end 104. A nut 118 is threaded onto the threaded end 112 of the pin 108. Finally, a washer 120 is placed on the pin 108 between the end 104 and the nut 118. Alternatively, the pin 108 may be solid or hollow with swaged heads to secure the fork portion 102 to the pivot block member 68. In this manner, the fork portion 102 and the handle 12 are able to move relative to the sanding head 14. Additionally, the handle 14 is capable of being rotated from 0° to about 180° with the only impediment to complete rotation being the sanding head 14 contacting the handle 12.

The pivot block member 68 also has a channel or passage 122 centrally located through the cup retaining end 66. The passage 122 ends at the second end 72 of the pivot block member 68. The passage 122 is provided for receiving the shaft 44. Although not shown, a pin is inserted through an opening in the pivot block member 68 to hold the shaft 44 in place. Alternatively, the channel 92 may be lowered on the pivot block member 68 to be aligned with the shaft 44 and the pin 108 would serve to hold the shaft 44 in place. The handle 12 is also shown to include the wire 84 emanating from a grommet 124. The wire 84 is connected to the coil member 78 and also up through the interior of the handle 12 to the switch 26.

The pivot block member 68 and the fork portion 102 are an example of a universal joint 126 which is used for connecting the handle 12 to the drive system 16. The universal joint 126 is used to move the handle 12 about the sanding head 14 in two planes of motion while preventing rotational movement of the sanding head 14 relative to the handle 12. In this manner, the sanding head 14 may be maneuvered into corners and other tight spaces for sanding joint compound.

In operation, the sander 10 is positioned on joint compound which has been applied to a sheet or sheets of drywall. The switch 26 is operated and power is supplied to the motor 76. Prior to power being supplied, the sanding head 14 is in an initially centered positioned. Once power is supplied, the coil member 78 magnetically pulls the cup member 74 towards the coil member 78 against the bias of the spring centering system 88. The coil member 78 then releases the cup member 74 and the tension provided by the spring centering system 88 and the motor 76 pull the cup member 74 back to a center or initial position and continues in a sinusoidal motion until it reaches the reversal point in the other direction. This pushing and pulling type motion, which occurs at 60 cycles per second, reciprocates the sanding head 14 and the sandpaper 34 attached to the foam pad 32 in a sinusoidal motion. Since the sanding head 14 is moving at a peak speed of about 3 feet per second, the sander 10 slides or glides over the joint compound. This reduces any static friction engagement between the joint compound and the sandpaper 34. The speed and oscillatory motion of the sanding head 14 also tends to prevent the sandpaper 34 from gripping the joint compound. The foam pad 32 is used to compensate for any minor irregularities found in the joint compound or the drywall. Further, due to the high-speed motion of the sanding head 14, dust is shaken from the sandpaper 34 and is not allowed to build up on the sandpaper 34. This extends the life of the sandpaper 34 and sandpaper 34 does not need to be changed as often. As can be further appreciated from the use of the sander 10, the sanding head 14 is a linear type device which allows the sanding head 14 to sand into a corner and up to the ceiling.

Figure 4:
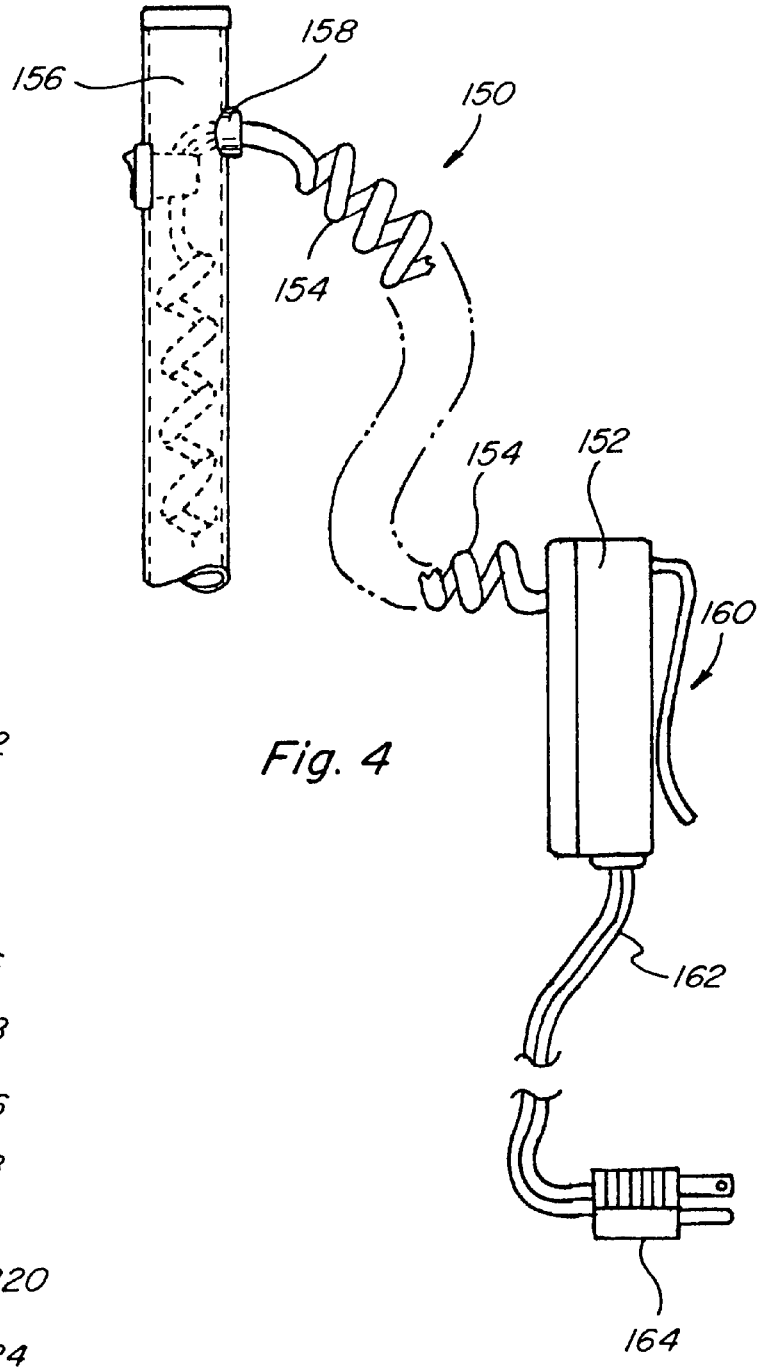
FIG. 4 is a partial perspective view of another preferred embodiment of a drywall sander constructed according to the present invention.

With reference now to FIG. 4, another preferred embodiment of a drywall sander 150 is shown. The sander 150 is similar to the sander 10 with the principal differences being the placement of a low voltage transformer 152. The low voltage transformer 152 is shown being connected by a low voltage wire 154 to a handle 156 through a grommet 158. The low voltage transformer 152 also has a clip 160 which is used to clip the transformer 152 to an operator (not shown) using the sander 150. The transformer 152 also has another higher voltage wire 162 which ends at an electrical plug 164. The plug 162 is adapted to be inserted into an electrical outlet (not shown) for supplying electricity to the sander 150 via the transformer 152. The wire 162 is very long and allows an operator to move a far distance from an electrical outlet. Use of the clip 160 prevents the plug 164 from being pulled out of an electrical outlet when using the sander 150. The other portions of the sander 150 not shown are identical to the sander 10.

Figure 5:
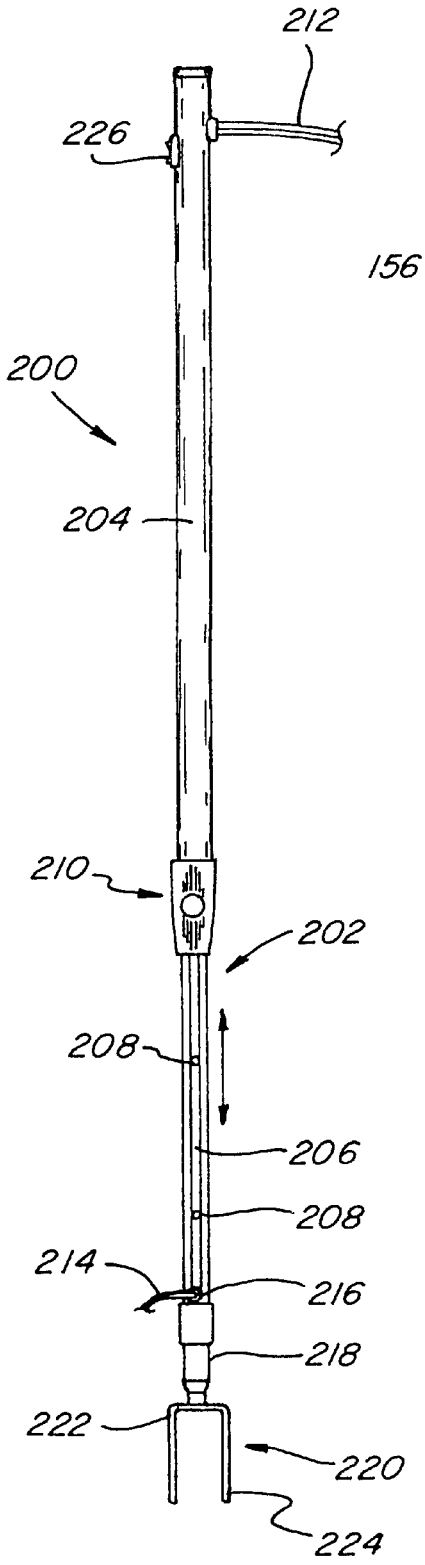
FIG. 5 is a perspective view of another preferred embodiment of a drywall sander constructed according to the present invention with a sanding head and a drive system removed from the sander.

FIG. 5 illustrates another preferred embodiment of a drywall sander 200. The sander 200 comprises a telescoping handle 202 which includes an outer handle member 204 and an inner handle member 206. The inner handle member 206 has a series of holes 208 which are used to retain or catch a release mechanism 210. The release mechanism 210 is used to move the outer handle member 204 relative to the inner handle member 206. The telescoping handle 202 is secured in place by the release mechanism 210 fitting into one of the holes 208. In this manner, the handle 202 may be extended to reach high places and collapsed to a smaller size. The other portions of the sander 200 which are similar to the sander 10 are not shown. The principal difference between the sander 200 and the sander 10 is the telescoping handle 202.

The sander 200 also includes an electrical cord 212 which is connected to a low voltage transformer (not shown), such as the transformer 22 or 152. The cord 212 within the handle 202 is coiled so that the handle 202 may be easily extended or collapsed. The inner handle member 206 has a low voltage wire 214 extending out from a grommet 216. Although not shown, the wire 214 is connected to the coil assembly 78 associated with the motor 76. The inner handle member 206 further includes an end portion 218 which is connected to a yoke or fork portion 220. The fork portion 220 has a an end 222 having an opening 224 through which a bolt or a pin, such as the pin 108, may be inserted. Finally, the sander 200 is provided with a power switch 226 which is connected between both of the wires 212 and 214.

Although not shown, it is also possible for the driving system 16 to include a shield or cap to cover the ends 46 and 48 of the shaft 44. Additionally, a diaphragm or cover, also not shown, may be used to cover the motor 76 at the end where the coil member 78 is located. This cover would serve to prevent dust from entering into the cover or the motor 76. Lastly, it is also possible to fit electrical circuitry which would serve as either the transformer 22 or 152 into the handle 12.

It should be further recognized that the drywall sander of the present invention can be constructed of various materials and can be assembled from separable components or formed as a unitary construction. For example, the brackets 36 and 38 may be formed as part of the base portion 28 thereby eliminating the screws 40 and the nuts 42. Additionally, the formed or molded brackets could extend along the length of the base portion 28 to add strength and rigidity to the base portion 28. Preferably, the drywall sander will be of relatively lightweight materials so that it can be easily positioned, moved, and carried about a work site in order to sand joint compound from drywall and drywall joints.

From all that has been said, it will be clear that there has thus been shown and described herein a drywall sander which fulfills the various objects and advantages sought therefor. It will become apparent to those skilled in the art, however, that many changes, modifications, variations, and other uses and applications of the subject drywall sander are possible and contemplated. All changes, modifications, variations, and other uses and applications which do not depart from the spirit and scope of the invention are deemed to be covered by the invention, which is limited only by the claims which follow.

What is claimed is:

1. A drywall sander comprising:

a handle;

a sanding head adapted to being reciprocated for back and forth motion;

a linear motor associated with the sanding head for reciprocating the sanding head;

a universal joint for connecting the handle to the linear motor;

and a tune pre-loaded spring mass centering system which positions the handle in a center position relative to the sanding head, wherein the tuned pre-loaded spring mass centering system reduces heat generated by the linear motor and increases the force available to reverse the motion of the sanding head.

2. The drywall sander of claim 1 wherein the universal joint provides movement of the handle relative to the sanding head in two planes.

3. The drywall sander of claim 1 wherein the universal joint comprises a fork shaped member having one end connected to the handle and the other ends of the member connected to a pivot block associated with the power actuating means.

4. The drywall sander of claim 1 wherein the linear motor comprises a permanent magnet moving coil motor which is used as a linear drive to minimize energy used by the motor and heat generated by the motor.

5. The drywall sander of claim 4 wherein the moving coil actuator comprises a magnetic cup member and a coil member inserted into the cup member.

6. The drywall sander of claim 1 wherein the linear motor has a natural frequency of operation and the tuned pre-loaded spring mass centering system is tuned to the natural frequency of operation of the linear motor.

7. A lightweight electrically operated drywall sander comprising:

a handle;

a sanding head adapted to being reciprocated;

a drive system associated with the sanding head for reciprocating the sanding head;

a universal joint for connecting the handle to the drive system for moving the handle relative to the sanding head into various positions; and the drive system further comprising a pre-loaded spring centering system which positions the handle in a center position relative to the sanding head.

8. The drywall sander of claim 7 wherein the pre-loaded spring centering system reduces heat generated by the drive system.

9. The drywall sander of claim 7 wherein the universal joint comprises a fork shaped member having one end connected to the handle and the other ends of the member connected to the drive system.

10. The drywall sander of claim 7 wherein the drive system further comprises a pivot block and the universal joint comprises a fork shaped member having one end connected to the handle and the other ends of the member connected to the pivot block.

11. The drywall sander of claim 7 wherein the handle is telescoping.

12. The drywall sander of claim 7 wherein the drive system comprises a moving coil actuator.

13. A drywall sander comprising:

a handle;

a sanding head adapted for reciprocating motion;

a moving coil actuator for providing the reciprocating motion to the sanding head;

a pre-loaded spring centering system for centering the sanding head prior to the sanding head being reciprocated; and a universal joint for connected the handle to the motor and for moving the sanding head relative to the handle.

14. The drywall sander of claim 13 further comprising a shaft associated with the actuator for moving the sanding head relative to the shaft.

15. The drywall sander of claim 13 wherein the pre-loaded spring centering system comprises a pair of compression springs mounted on a shaft.

16. The drywall sander of claim 13 further comprising a low voltage transformer which is adapted to being clipped to an operator.

17. The drywall sander of claim 13 wherein the moving coil actuator has a natural frequency of operation and the pre-loaded spring centering system is tuned to the frequency of input voltage of the moving coil actuator.

* * * * *